US006861919B2

(12) United States Patent
Shimizu

(10) Patent No.: US 6,861,919 B2
(45) Date of Patent: Mar. 1, 2005

(54) IRREVERSIBLE CIRCUIT DEVICE WITH SMALL INSERTION LOSS AND EXCELLENT ISOLATION HAVING A Y-SHAPED FERRITE

(75) Inventor: Yuichi Shimizu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/635,158

(22) Filed: Aug. 6, 2003

(65) Prior Publication Data

US 2004/0036548 A1 Feb. 26, 2004

(30) Foreign Application Priority Data

Aug. 21, 2002 (JP) ..... 2002-240143

(51) Int. Cl.[7] ..... H01P 1/38
(52) U.S. Cl. ..... 333/1.1; 333/24.2
(58) Field of Search ..... 333/1.1, 24.2

(56) References Cited

U.S. PATENT DOCUMENTS 3,341,789 A * 9/1967 Goodman et al. ..... 333/1.1
2002/0079981 A1 * 6/2002 Tanaka ..... 333/1.1
2002/0171504 A1 * 11/2002 Takeda et al. ..... 333/24.2
2003/0006855 A1 * 1/2003 Yoneda ..... 333/1.1

FOREIGN PATENT DOCUMENTS

JP 2001-185914 7/2001

* cited by examiner

*Primary Examiner*—Robert Pascal
*Assistant Examiner*—Stephen E. Jones
(74) *Attorney, Agent, or Firm*—Brinks Hofer Gilson & Lione

(57) ABSTRACT

An irreversible circuit device with small insertion loss and excellent isolation is to be provided. An irreversible circuit device according to the invention has a flat plate shaped ferrite member and first, second and third central conductors placed on the ferrite member. In the central conductors, second conductor parts are placed on the ferrite member as input or output first conductor parts are placed on notch parts of the ferrite member. Therefore, when a magnetic flux passes through V-shaped extension parts as a magnetic path, the current generation is reduced and the energy transmission is increased in the first conductor part placed therebetween. Consequently, the insertion loss is reduced, and the isolation becomes excellent.

3 Claims, 5 Drawing Sheets

IRREVERSIBLE CIRCUIT DEVICE WITH SMALL INSERTION LOSS AND EXCELLENT ISOLATION HAVING A Y-SHAPED FERRITE

BACKGROUND OF THE INVENTION

1. Field of the Invention

The present invention relates to an irreversible circuit device such as a circulator and an isolator adapted to a duplexer.

2. Description of the Related Art

The configuration of a traditional irreversible circuit device will be described with reference to FIGS. 6 and 7. The traditional irreversible circuit device is configured of a U-shaped first yoke 51, a magnet 52 disposed inside the first yoke 51, a disk-shaped ferrite member 53 disposed under the magnet 52, three central conductors 54, 55 and 56 made of metal plates mounted on the ferrite member 53 at an angle of 120 degrees spaced as parts of them cross each other, a holding member 57 for holding the ferrite member 53, and a U-shaped second yoke 58.

In addition, the ferrite member 53 having the central conductors 54, 55 and 56 mounted thereon is inserted into a hole 57*a* of the holding member 57, and is covered with the first and second yokes 51 and 58 from above and below in a state that the magnet 52 is disposed on the ferrite member 53.

Then, the first and second yokes 51 and 58, in which the U-shaped parts are alternately put together, are combined to form a magnetic closed circuit by the first and second yokes 51 and 58 in a state that the magnet 52, the ferrite member 53 and the holding member 57 are sandwiched by the first and second yokes 51 and 58.

Furthermore, as shown in FIG. 7, the three central conductors 54, 55 and 56 are formed of thin metal plates, and each of them is connected to a capacitor C, which are configured of input or output first conductor parts 54*a*, 55*a* and 56*a* and second conductor part 54*b*, 55*b* and 56*b* on the ground side connected to the first conductor parts 54*a*, 55*a* and 56*a*. In each of three central conductors 54, 55 and 56, the first conductor parts 54*a*, 55*a* and 56*a* and the second conductor parts 54*b*, 55*b* and 56*b* are placed on the ferrite member 53.

Then, for example, when a signal is inputted to the first conductor part 54*a* of the central conductor 54, a current I flows through the second conductor part 54*b*. Subsequently, a magnetic flux is generated on the second conductor part 54*b* side, and the magnetic flux affects the second conductor part 55*b* through the ferrite member 53 placed between the second conductor part 54*b* and the second conductor part 55*b* as a magnetic path G.

Consequently, the current I is generated in the second conductor part 55*b* of the central conductor 55 and is outputted from the first conductor part 55*a*.

Moreover, when the magnetic flux passes through the ferrite member 53 placed between the second conductor part 54*b* and the second conductor part 55*b* as the magnetic path G, unnecessary current is generated in the first conductor part 56*a* of the central conductor 56 placed therebetween, and the energy to be transmitted is lost in a large amount in the process of transmission. Consequently, the insertion loss is increased, and the isolation is deteriorated.

Additionally, also in the cases where a signal is inputted from the central conductor 55 and outputted from the central conductor 56 and where a signal is inputted from the central conductor 56 and outputted from the central conductor 54, the insertion loss is increased and the isolation is deteriorated by the same principles as described above.

SUMMARY OF THE INVENTION

The traditional irreversible circuit device has problems that the energy to be transmitted is lost in a large amount in the process of transmission due to the existence of the ferrite member 53 placed under the first conductor parts 54*a*, 55*a* and 56*a*, because the first conductor parts 54*a*, 55*a* and 56*a* and the second conductor parts 54*b*, 55*b* and 56*b* of the central conductors 54, 55 and 56 are placed on the ferrite member 53, thereby increasing the insertion loss and deteriorating the isolation.

Then, an object of the invention is to provide an irreversible circuit device with small insertion loss and excellent isolation.

As a first means for solving the above problems, an irreversible circuit device according to the invention is configured to have:

a flat plate shaped ferrite member; and first, second and third central conductors placed on the ferrite member and disposed on surfaces different in the vertical direction as a dielectric is sandwiched therebetween with parts thereof crossed in the vertical direction, wherein the central conductors have an input or output first conductor part and a second conductor part placed on a ground side, the second conductor part is connected to the first conductor part, the ferrite member is formed with a notch part at a position facing the first conductor part, and the second conductor part is placed on the ferrite member.

In addition, as a second means for solving the problems, the irreversible circuit device according to the invention is configured in which the ferrite member is formed in a Y shape, the first conductor part of the first, second and third central conductors is placed on the notch part, and the second conductor part of the first, second and third central conductors is placed on the ferrite member.

Furthermore, as a third means for solving the problems, the irreversible circuit device according to the invention is configured in which the notch part is formed at an angle of about 120 degrees.

Moreover, as a fourth means for solving the problems, the irreversible circuit device according to the invention is configured in which the notch part is formed near a crossing part of the central conductors.

The irreversible circuit device according to the invention is configured to have the flat plate shaped ferrite member and the first, second and third central conductors placed on the ferrite member and disposed on the surfaces different in the vertical direction as the dielectric is sandwiched therebetween with parts thereof crossed in the vertical direction, wherein the central conductors have the input or output first conductor part and the second conductor part placed on the ground side, the second conductor part is connected to the first conductor part, the ferrite member is formed with the notch part at the position facing the first conductor part, and the second conductor part is placed on the ferrite member.

According to the configuration, when a magnetic flux passes through V-shaped extension parts as a magnetic path G, the current generation is reduced and the energy transmission is increased in the first conductor part of the central conductor placed therebetween. Consequently, the insertion loss is reduced, and the isolation becomes excellent.

Additionally, the ferrite member is formed in the Y shape, the first conductor part of the first, second and third central conductors is placed on the notch part, and the second conductor part of the first, second and third central conductors is placed on the ferrite member. Therefore, the portion facing the ferrite member in the first conductor part can be reduced, the insertion loss is further reduced, and the isolation becomes excellent.

Furthermore, the notch part is formed at an angle of about 120 degrees. Thus, the portion facing the ferrite member in the first conductor part can be further reduced, the insertion loss is further reduced, and the isolation becomes excellent.

Moreover, the notch part is formed near the crossing part of the central conductors. Therefore, the portion facing the ferrite member in the first conductor part can be further reduced, the insertion loss is further reduced, and the isolation becomes excellent.

BRIEF DESCRIPTION OF THE DRAWINGS

The teachings of the invention can be readily understood by considering the following detailed description in conjunction with the accompanying drawings, in which.

DESCRIPTION OF THE PREFERRED EMBODIMENT

Figure 1:
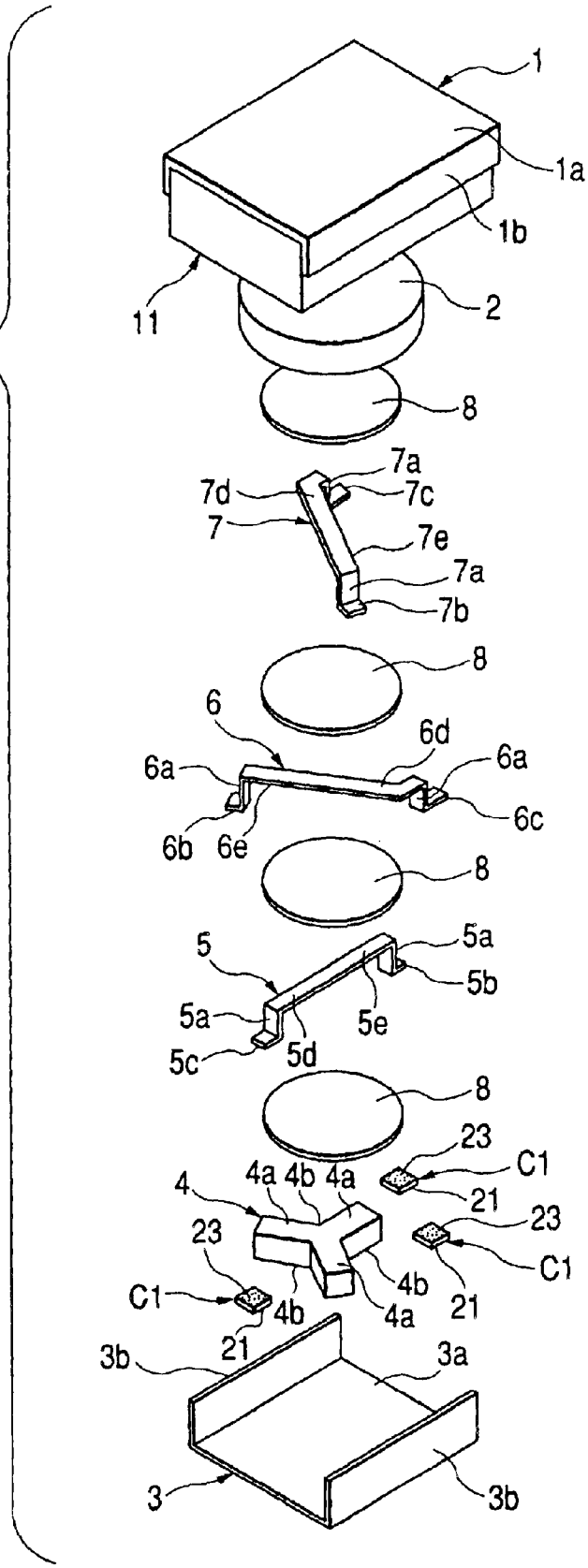
FIG. 1 is an exploded perspective view illustrating an irreversible circuit device according to the invention.
Figure 2:
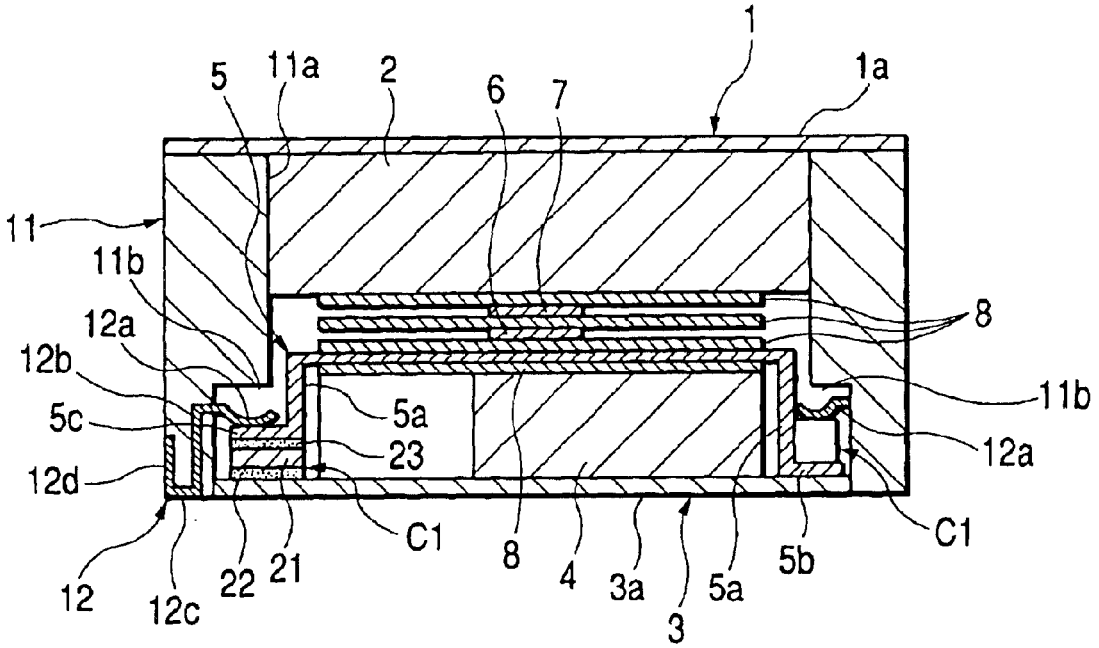
FIG. 2 is a cross-sectional view illustrating the essential part of the irreversible circuit device according to the invention.
Figure 3:
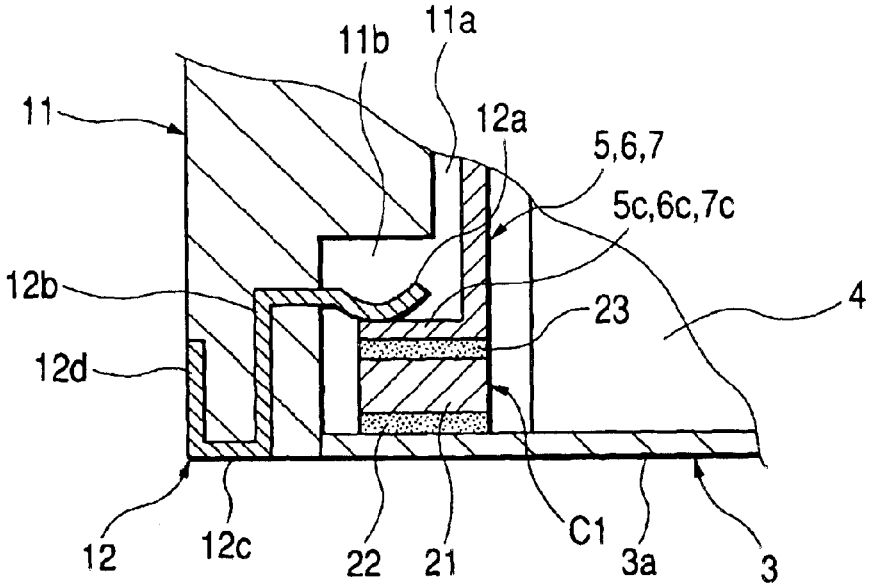
FIG. 3 is an enlarged cross-sectional view illustrating the essential part of the irreversible circuit device according to the invention.
Figure 4:
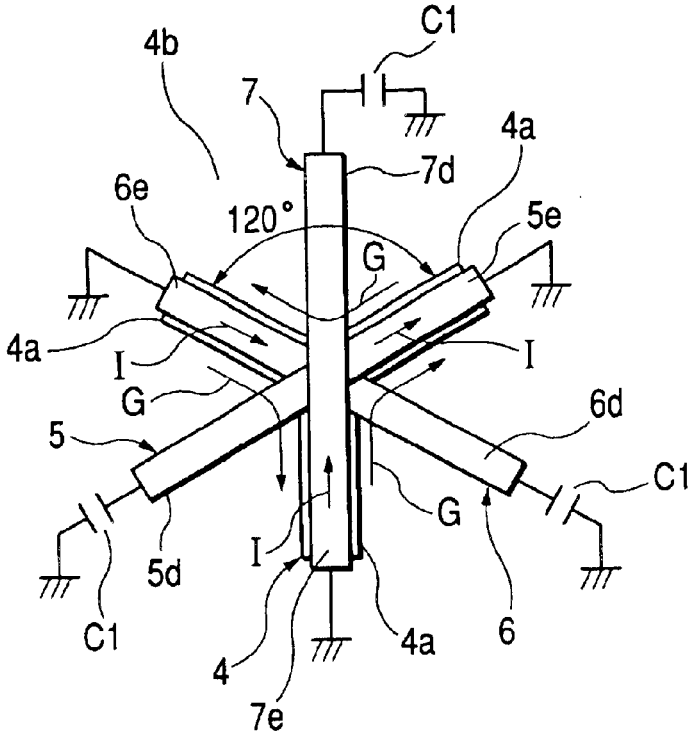
FIG. 4 is an explanatory diagram for illustrating the essential part of the irreversible circuit device according to the invention.
Figure 5:
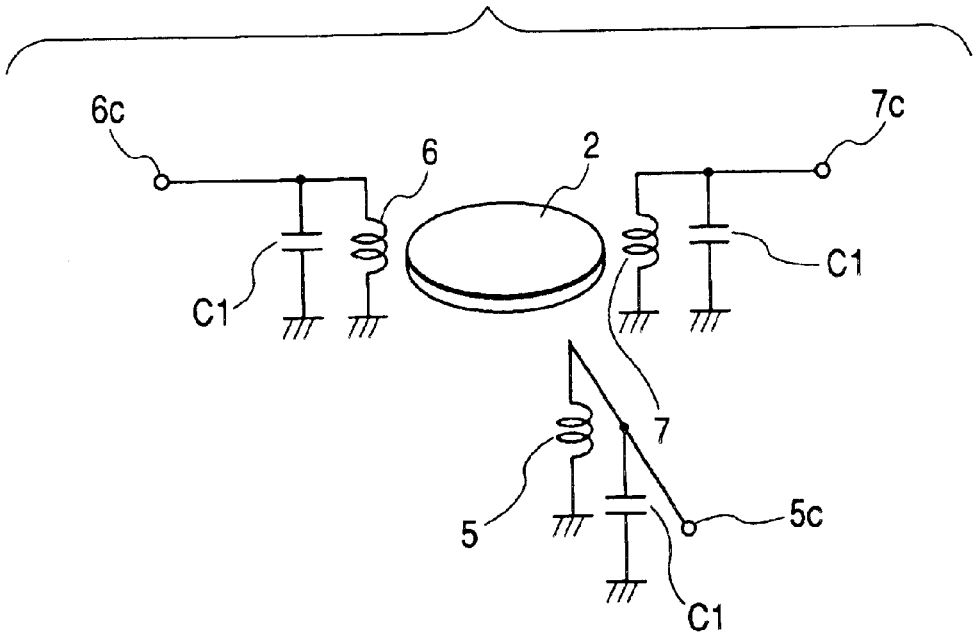
FIG. 5 is an equivalent circuit diagram where the irreversible circuit device according to the invention is adapted to a circulator.
Figure 6:
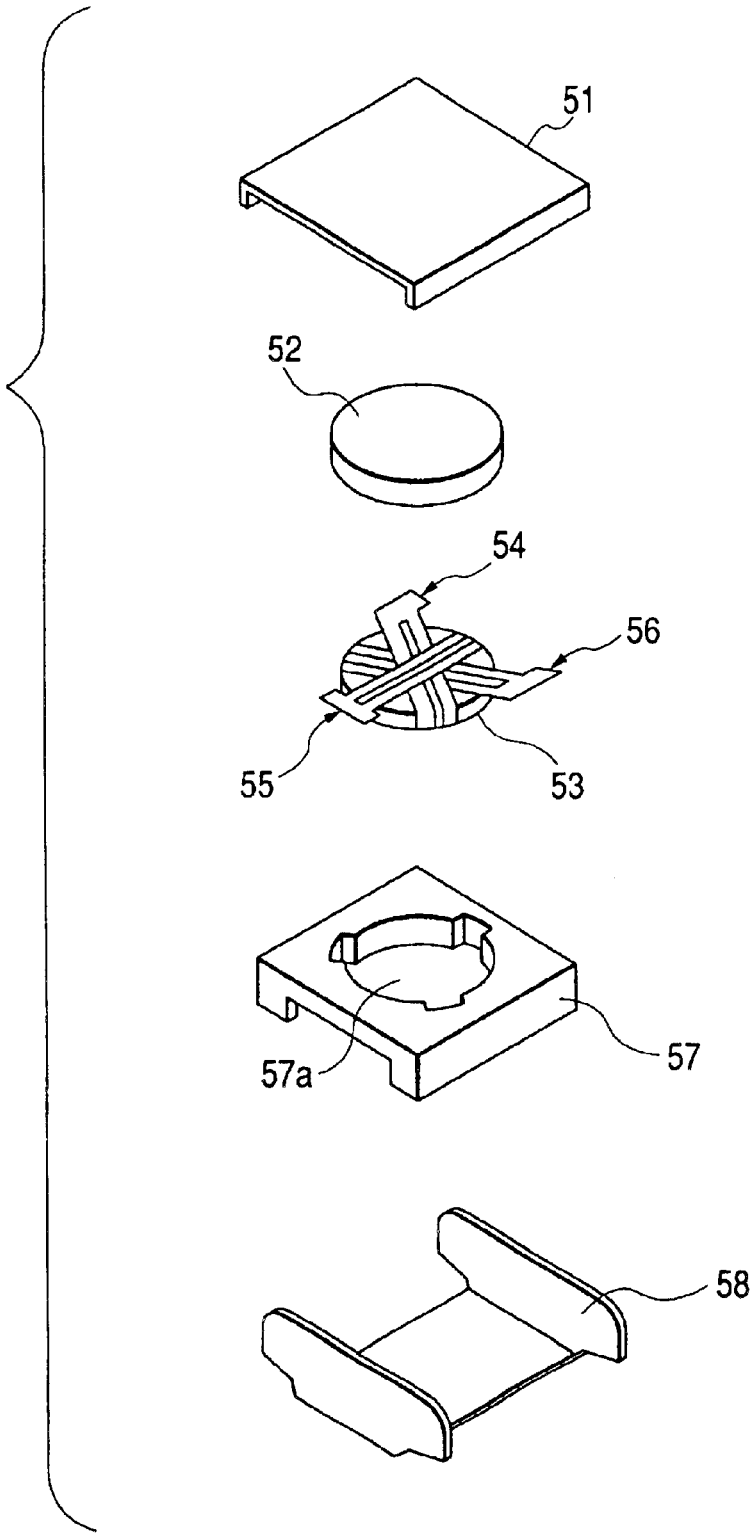
FIG. 6 PRIOR ART
FIG. 6 is an exploded perspective view illustrating the traditional irreversible circuit device.
Figure 7:
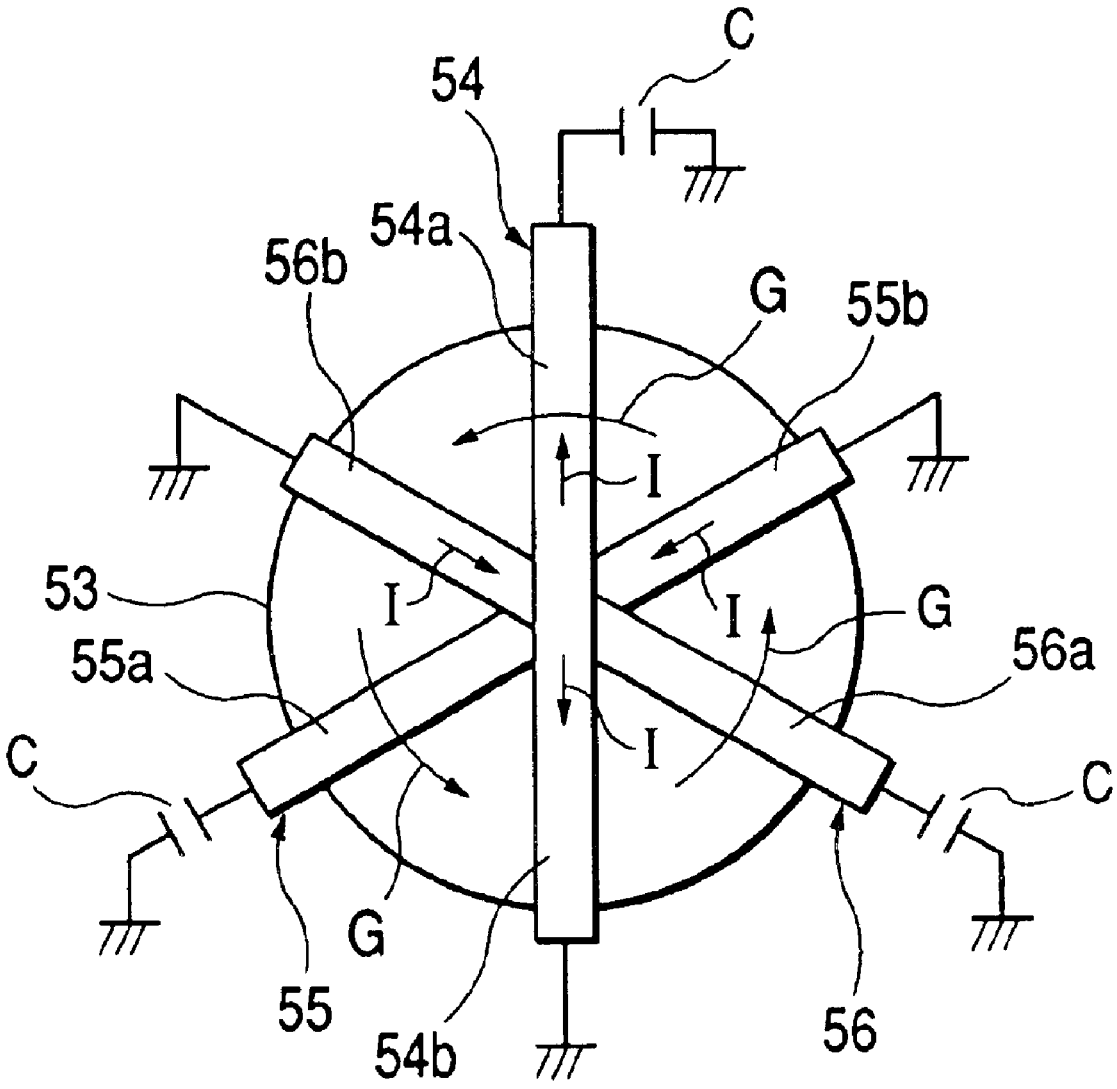
FIG. 7 PRIOR ART
FIG. 7 is an explanatory diagram for illustrating the essential part of the traditional irreversible circuit device.

The drawings of an irreversible circuit device according to the invention will be described. FIG. 1 is an exploded perspective view illustrating the irreversible circuit device according to the invention. FIG. 2 is a cross-sectional view illustrating the essential part of the irreversible circuit device according to the invention. FIG. 3 is an enlarged cross-sectional view illustrating the essential part of the irreversible circuit device according to the invention. FIG. 4 is an explanatory diagram for illustrating the essential part of the irreversible circuit device according to the invention. FIG. 5 is an equivalent circuit diagram where the irreversible circuit device according to the invention is adapted to a circulator.

Next, the configuration of the irreversible circuit device according to the invention will be described based on FIGS. 1 to 4. A first yoke 1 made of a U-shaped magnetic plate (iron plate or the like) has a rectangular top plate 1*a* and a pair of side plates 1*b* bent downward from the sides of the top plate 1*a* facing each other.

A rectangular parallelepiped support member 11 formed of a molded product of synthetic resin is configured of two separate members each other or a single member, and the support member 11 has a cylindrical hollow part 11*a* disposed in the center part and a notch part 11*b* disposed under the hollow part 11*a*.

Then, the support member 11 is mounted inside the first yoke 1, and the support member 11 is formed in one piece with the first yoke 1 by molding.

A terminal member 12 made of a metal member having spring properties has a contact part 12*a*, a connecting part 12*c* joined to the contact part 12*a* through a joining part 12*b*, and a bend part 12*d* bent from one end of the connecting part 12*c*.

A plurality of the terminal members 12 is embedded and mounted on under the support member 11 by molding. When the terminal members 12 are mounted on the support member 11, the contact part 12*a* is placed and extended from the position of the notch part 11*b* in the center direction, the connecting part 12*c* is exposed from the lower surface of the support member 11, and the bend part 12*d* is disposed as exposed from the side of the support member 11.

A disk-shaped magnet 2 is inserted and placed in the hollow part 11*a* of the support member 11, and the peripheral surface of the magnet 2 is supported and positioned by the support member 11.

A second yoke 3 formed of a U-shaped magnetic plate (iron plate or the like) has a rectangular base plate 3*a* and a pair of side plates 3*b* bent upward from sides of the base plate 3*a* facing each other.

Then, the pair of side plates 3*b* of the second yoke 3 is joined to the pair of side plates 1*b* of the first yoke 1 to form a magnetic closed circuit, and the support member 11 is placed inside the second yoke 3.

A Y-shaped ferrite member 4 made of YIG (Yttrium Iron Garnet) or he like has extension parts 4*a* extended from the center in the three directions and V-shaped notch parts 4*b* between the extension parts 4*a* formed at an angle of about 120 degrees, and the ferrite member 4 is mounted as placed on the base plate 3*a* of the second yoke 3.

Additionally, chip type capacitor C1 are configured of an insulator 21 made of plate-like ceramic and first and second electrode parts 22 and 23 made of silver or the like disposed on two flat surfaces of the insulator 21 facing each other, and a capacitance is formed between the first and second electrode parts 22 and 23 facing each other.

In the three chip type capacitors C1, the first electrode part 22 is soldered on the base plate 3*a* of the second yoke 3 and mounted on the second yoke 3, being grounded to the second yoke 3.

First, second and third central conductors 5, 6 and 7 formed of thin conductive plates made of copper or the like have pairs of bend parts 5*a*, 6*a* and 7*a* disposed on both ends, connecting parts 5*b*, 6*b* and 7*b* disposed on one ends of the bend parts 5*a*, 6*a* and 7*a*, terminal parts 5*c*, 6*c* and 7*c* formed by bending on the other ends of the bend parts 5*a*, 6*a* and 7*a*, input or output first conductor parts 5*d*, 6*d* and 7*d* placed on the terminal parts 5*c*, 6*c* and 7*c* sides, and second conductor parts 5*e*, 6*e* and 7*e* placed the connecting parts 5*b*, 6*b* and 7*b* sides.

Then, the first, second and third central conductors 5, 6 and 7 are disposed on the surfaces different in the vertical direction as a dielectric 8 made of an insulating material is sandwiched therebetween at an angle of 120 degrees spaced, and parts thereof cross each other in the vertical direction.

Additionally, the first, second and third central conductors 5, 6 and 7 are placed on the ferrite member 4 through the dielectric 8.

At this time, in the first, second and third central conductors 5, 6 and 7, the terminal parts 5*c*, 6*c* and 7*c* are soldered and electrically connected to the second electrode parts 23 of the chip type capacitors C1, respectively, and the connecting parts 5*b*, 6*b* and 7*b* are soldered and electrically connected to the base plate 3*a* of the second yoke 3 in a grounded state.

More specifically, the capacitors C1 are connected to the input or output first conductor parts 5*d*, 6*d* and 7*d*, and the second conductor parts 5*e*, 6*e* and 7*e* for ground are grounded.

Furthermore, as shown in FIG. 4, the first, second and third central conductors 5, 6 and 7 placed on the ferrite member 4 have the first conductor parts 5*d*, 6*d* and 7*d* placed on the notch parts 4*b* and have the second conductor parts 5*e*, 6*e* and 7*e* placed on the extension parts 4*a*.

At this time, as shown in FIG. 4, the width of the extension parts 4*a* is slightly wider than the width of the second conductor parts 5*e*, 6*e* and 7*e*, and the extension parts 4*a* are extended off the both sides of the second conductor parts 5*e*, 6*e* and 7*e*. The corner of the notch parts 4*b* is formed near the crossing parts of the first, second and third central conductors 5, 6 and 7.

Although the notch part 4*b* disposed in the ferrite member 4 is described as a V shape, a U shape is acceptable. In short, it is fine to dispose the notch part at the position to face a part or almost all of the under part of the first conductor part.

When the first yoke 1 mounted with the support member 11 is combined with the second yoke 3 holding the first, second and third central conductor 5, 6 and 7 to assemble the first, second and third central conductor 5, 6 and 7, the contact parts 12*a* of the terminal members 12 contact the terminal parts 5*c*, 6*c* and 7*c* placed on the second electrode part 23 in an elastically contacted state.

At this time, the lower surface of the connecting part 12*c* of the terminal member 12 is nearly flushed to the lower surface of the base plate 3*a* of the second yoke 3.

The magnet 2 positioned by the first yoke 1 is placed on the first, second and third central conductor 5, 6 and 7. The side plates 1*b* and 3*b* of the first and second yokes 1 and 3 are combined with each other in this state, the magnet 2 and the ferrite member 4 are sandwiched between the first and second yokes 1 and 3, and then an irreversible circuit device formed of a circulator or isolator is formed.

In addition, the irreversible circuit device having this configuration is not shown in the drawing here, but it is mounted on a circuit board having conductive patterns by surface mounting.

Then, when the irreversible circuit device is mounted, the lower surface of the base plate 3*a* of the second yoke 3 and the lower surface of the connecting part 12*c* of the terminal members 12 are placed on the circuit board in a flushed state for soldering. The connecting parts 12*c* are soldered to the conductive patterns for wiring, and the base plate 3*a* of the second yoke 3 is soldered to the conductive patterns for ground.

At this time, since the terminal members 12 have the exposed bend parts 12*d* soldered along with the connecting parts 12*c*, the terminal members 12 can be soldered surely to the conductive patterns.

As shown in FIG. 4, in the irreversible circuit device according to the invention having this configuration, when a signal is inputted to the first conductor part 5*d* of the central conductor 5, for example, a current I flows through the second conductor part 5*e*. Then, a the magnetic flux is generated in the second conductor part 5*e*, and the magnetic flux affects the second conductor part 6*e* of the second central conductor 6 through the V-shaped extension parts 4*a* as a magnetic path G.

Consequently, the current I is generated in the second conductor part 6*e* of the second central conductor 6 and is outputted from the first conductor part 6*d*.

In addition, when the magnetic flux passes through the V-shaped extension parts 4*a* as the magnetic path G, the current generation is reduced and the energy transmission is increased in the first conductor part 7*d* of the third central conductor 7 placed therebetween. Consequently, the insertion loss is reduced, and the isolation becomes excellent.

Furthermore, also in the cases where a signal is inputted from the second central conductor 6 and outputted from the third central conductor 7 and where a signal is inputted from the third central conductor 7 and outputted from the first central conductor 5, the insertion loss is reduced and the isolation becomes excellent by the same principles as described above.

Moreover, FIG. 5 depicts an equivalent circuit diagram where the irreversible circuit device according to the invention is adapted to a circulator in which the terminal parts 5*c*, 6*c* and 7*c* to be input/output terminals are disposed on one ends of the first, second and third central conductor 5, 6 and 7, respectively, the connecting parts 5*b*, 6*b* and 7*b* to be the other ends thereof are grounded, and the grounded chip type the capacitors C1 are connected to the terminal parts 5*c*, 6*c* and 7*c* of the first, second and third central conductor 5, 6 and 7.

What is claimed is:

1. An irreversible circuit device comprising:

a flat plate shaped ferrite member; and first, second and third central conductors placed on the ferrite member and disposed on surfaces different in a vertical direction as a dielectric is sandwiched therebetween with parts thereof crossed in the vertical direction, wherein the central conductors have an input or output first conductor part and a second conductor part placed on a ground side, the second conductor part is connected to the first conductor part, the ferrite member is formed with a notch part at a position facing the first conductor part, the ferrite member is formed in a Y shape, the first conductor parts of the first, second and third central conductors are placed on the notch part, and the second conductor parts of the first, second and third central conductors are placed on the ferrite member.

2. The irreversible circuit device according to claim 1, wherein the notch part is formed at an angle of about 120 degrees.

3. The irreversible circuit device according to claim 1, wherein the notch part is formed near a crossing part of the central conductors.

* * * * *